US011661809B2

(12) United States Patent
Ejim et al.

(10) Patent No.: US 11,661,809 B2
(45) Date of Patent: May 30, 2023

(54) LOGGING A WELL

(71) Applicant: Saudi Arabian Oil Company, Dhahran (SA)

(72) Inventors: Chidirim Enoch Ejim, Dhahran (SA); Brian A. Roth, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/895,406

(22) Filed: Jun. 8, 2020

(65) Prior Publication Data

US 2021/0381327 A1 Dec. 9, 2021

(51) Int. Cl.

| | |
|---|---|
| ***E21B 23/14*** | (2006.01) |
| ***E21B 47/12*** | (2012.01) |
| ***E21B 17/20*** | (2006.01) |
| ***E21B 47/01*** | (2012.01) |

(52) U.S. Cl.

CPC ..... *E21B 23/14* (2013.01); *E21B 17/206* (2013.01); *E21B 47/01* (2013.01); *E21B 47/12* (2013.01)

(58) Field of Classification Search

CPC ..... E21B 23/14; E21B 23/08; E21B 17/206; E21B 47/01; E21B 47/12; E21B 43/126; E21B 43/128; E21B 43/121

See application file for complete search history.

(56) References Cited

U.S. PATENT DOCUMENTS

| | | | |
|---|---|---|---|
| 7,730,937 | B2 | 6/2010 | Head |
| 8,950,476 | B2 | 2/2015 | Head |
| 9,353,614 | B2 | 5/2016 | Roth et al. |
| 9,587,456 | B2 | 3/2017 | Roth |
| 9,593,561 | B2 | 3/2017 | Xiao et al. |
| 9,631,482 | B2 | 4/2017 | Roth et al. |
| 9,951,598 | B2 | 4/2018 | Roth et al. |
| 10,100,596 | B2 | 10/2018 | Roth et al. |
| 10,138,885 | B2 | 11/2018 | Ejim et al. |
| 10,151,194 | B2 | 12/2018 | Roth et al. |
| 10,253,610 | B2 | 4/2019 | Roth et al. |
| 10,287,853 | B2 | 5/2019 | Ejim et al. |
| 10,337,302 | B2 | 7/2019 | Roth et al. |
| 10,337,312 | B2 | 7/2019 | Xiao et al. |
| 10,378,322 | B2 | 8/2019 | Ejim et al. |
| 10,465,477 | B2 | 11/2019 | Abdelaziz et al. |
| 10,465,484 | B2 | 11/2019 | Turner et al. |

(Continued)

FOREIGN PATENT DOCUMENTS

| | | | | |
|---|---|---|---|---|
| CA | 2922264 C | * | 10/2020 | ..... E21B 17/003 |
| GB | 2477909 | | 8/2011 | |
| WO | 2009113894 | | 9/2009 | |

OTHER PUBLICATIONS

PCT International Search Report and Written Opinion in International Appln. No. PCT/US2021/036145, dated Sep. 24, 2021, 14 pages.

*Primary Examiner* — Caroline N Butcher
(74) *Attorney, Agent, or Firm* — Fish & Richardson P.C.

(57) ABSTRACT

A downhole tool system includes an electrical submersible pump (ESP) assembly configured to couple to a downhole conveyance that includes a production fluid flow path for a production fluid from a subterranean formation; and a logging sub-assembly directly coupled to a downhole end of the ESP assembly and including a length of logging cable spoolable off a cable spool of the logging sub-assembly within a wellbore.

26 Claims, 6 Drawing Sheets

(56) References Cited

U.S. PATENT DOCUMENTS

| | | | | |
|---|---|---|---|---|
| 10,533,558 | B2 | 1/2020 | Melo et al. | |
| 10,578,111 | B2 | 3/2020 | Xiao et al. | |
| 2004/0045705 | A1 | 3/2004 | Gardner et al. | |
| 2009/0084543 | A1* | 4/2009 | Fitzgerald | E21B 47/00 166/250.01 |
| 2015/0021014 | A1 | 1/2015 | Hughes et al. | |
| 2017/0075017 | A1* | 3/2017 | Jasskelainen | G01V 1/52 |
| 2018/0274343 | A1* | 9/2018 | Ejim | E21B 33/12 |
| 2019/0368291 | A1 | 12/2019 | Xiao et al. | |

* cited by examiner

LOGGING A WELL

TECHNICAL FIELD

This disclosure relates to logging a well and, more particularly, logging a well downhole of a hydrocarbon production unit positioned in a wellbore.

BACKGROUND

Gaining access within a wellbore below hydrocarbon production unit, such as a pump or production inlet, may be desirable for a field asset operator to determine, for example, reservoir characteristics. Conventionally, bypass equipment, such as a "Y-tool," allows the capability of accessing a reservoir for logging purposes when a pump (for example, an electrical submersible pump (ESP)) is installed. Installation of Y-tools are typically restricted to a casing size of a completion of the wellbore. To log a well with a Y-Tool installed, a logging crew needs to be mobilized for the operation. Access to the well is via the by-pass leg of the Y-Tool. Mobilizing crews to perform logging operations can take some time to schedule the job depending on, for example, an availability of the logging crew. This incurs non-productive time for the field asset operator to acquire needed reservoir data for production planning. Furthermore, mobilizing a logging crew can be expensive, and even more so when there may be limited availability of the crew. Such high costs translate to a non-economical bottom line for a well operator.

SUMMARY

This disclosure describes a downhole tool for logging a well (also called a wellbore). In some aspects, the downhole tool includes a production sub-assembly and a logging sub-assembly coupled to a downhole end of the production sub-assembly. The production sub-assembly operates to produce a wellbore fluid to the surface (for example, by artificial lift or natural circulation, or both) in a production operation. The logging sub-assembly operates to log a portion of the wellbore downhole of the downhole tool in a logging operation. In some aspects, the downhole tool may simultaneously complete the production operation and the logging operation.

In an example implementation, a downhole tool includes a production unit configured to fluidly couple to a production tubing positioned in a wellbore that is formed from a terranean surface to a subterranean formation. The production unit includes an inlet configured to fluidly couple to the wellbore to receive a production fluid. The tool further includes a logging unit coupled to a downhole end of the production unit. The logging unit includes a cable spooler configured to move a cable from the cable spooler through the wellbore downhole of the production unit, the cable including one or more logging sensors, and a cable motor configured to operate the cable spooler to move the cable through the wellbore downhole of the production unit.

In an aspect combinable with the example implementation, the production unit includes a downhole pump assembly.

In another aspect combinable with any of the previous aspects, the downhole pump assembly includes a pump motor, a production fluid pump coupled to the pump motor, and a pump intake that includes the inlet.

In another aspect combinable with any of the previous aspects, the downhole pump assembly further includes a monitoring sub-assembly coupled to a downhole end of the pump motor, and a motor protector coupled between the pump motor and the intake.

In another aspect combinable with any of the previous aspects, the logging unit is coupled to the monitoring sub-assembly.

In another aspect combinable with any of the previous aspects, the downhole pump assembly includes an electrical submersible pump (ESP).

In another aspect combinable with any of the previous aspects, the cable includes a fiber optic cable.

In another aspect combinable with any of the previous aspects, the logging unit further includes a weight attached to a downhole end of the cable.

In another aspect combinable with any of the previous aspects, the one or more logging sensors is configured to record at least one of a resistivity, a conductivity, a pressure, a temperature, or a sonic property of the subterranean formation.

In another aspect combinable with any of the previous aspects, the logging unit is coupled to the inlet of the production unit.

In another aspect combinable with any of the previous aspects, the cable includes a fiber optic cable.

In another aspect combinable with any of the previous aspects, the logging unit further includes a weight attached to a downhole end of the cable.

In another aspect combinable with any of the previous aspects, the one or more logging sensors is configured to record at least one of a resistivity, a conductivity, a pressure, a temperature, or a sonic property of the subterranean formation.

In another example implementation, a method includes running a downhole tool into a wellbore on a production tubular. The wellbore is formed from a terranean surface to a subterranean formation. The downhole tool includes a production unit and a logging unit coupled to a downhole end of the production unit. The method further includes positioning the downhole tool in the wellbore adjacent the subterranean formation; unspooling a cable from the logging unit in a direction downhole of the downhole tool; logging the wellbore with the unspooled cable; and during logging of the wellbore, producing a wellbore fluid from the wellbore through an inlet of the production unit and into the production tubular.

In an aspect combinable with the example implementation, producing the wellbore fluid from the wellbore includes pumping the wellbore fluid from the wellbore with a downhole pump assembly of the production unit.

Another aspect combinable with any of the previous aspects further includes, during production of the wellbore fluid, measuring at least one parameter associated with the downhole pump assembly; and transmitting the measured at least one parameter to the terranean surface.

In another aspect combinable with any of the previous aspects, pumping the wellbore fluid from the wellbore with the downhole pump assembly of the production unit includes pumping the wellbore fluid from the wellbore with an electrical submersible pump (ESP) that includes an intake that includes the inlet.

In another aspect combinable with any of the previous aspects, logging the wellbore includes measuring one or more parameters of the subterranean formation with the cable that includes a fiber optic cable.

In another aspect combinable with any of the previous aspects, the one or more measured parameters of the subterranean formation includes at least one of a resistivity, a conductivity, a pressure, a temperature, or a sonic property.

In another aspect combinable with any of the previous aspects, producing the wellbore fluid from the wellbore includes receiving the wellbore fluid into the inlet of the production unit based at least in part on a pressure difference between the subterranean formation and the production string.

In another aspect combinable with any of the previous aspects, logging the wellbore includes measuring one or more parameters of the subterranean formation with the cable that includes a fiber optic cable.

In another aspect combinable with any of the previous aspects, the one or more measured parameters of the subterranean formation includes at least one of a resistivity, a conductivity, a pressure, a temperature, or a sonic property.

In another example implementation, a downhole tool system includes an electrical submersible pump (ESP) assembly configured to couple to a downhole conveyance that includes a production fluid flow path for a production fluid from a subterranean formation; and a logging sub-assembly directly coupled to a downhole end of the ESP assembly and including a length of logging cable spoolable off a cable spool of the logging sub-assembly within a wellbore.

In an aspect combinable with the example implementation, the ESP assembly includes a pump that includes an intake configured to fluidly couple to an annulus of the wellbore to receive the production fluid from the subterranean formation; and a pump motor coupled to the intake at a downhole end of the pump.

In another aspect combinable with any of the previous aspects, the logging sub-assembly further includes a spooler motor coupled to the cable spool and operable to spool the logging cable from and onto the cable spool; and a weight coupled to first portion of the logging cable opposite a second portion of the logging cable that is coupled to the cable spool.

Another aspect combinable with any of the previous aspects further includes at least one power cable electrically coupled to at least one of the pump motor or the spooler motor and configured to transfer electric current to the at least one of the pump motor or the spooler motor from a terranean surface.

In another aspect combinable with any of the previous aspects, the logging cable includes at least one fiber optic cable that includes at least one logging sensor.

In another aspect combinable with any of the previous aspects, the at least one logging sensor is configured to measure at least one of a resistivity, a conductivity, a pressure, a temperature, or a sonic property of the subterranean formation.

Implementations of a downhole tool according to the present disclosure may include one or more of the following features. For example, the downhole tool may enable or help enable logging access below a downhole pump, such as an electric submersible pump. As another example, the downhole tool may save service crew costs associated with logging a well if a conventional Y-tool (by-pass) tool was installed. As yet a further example, the downhole tool may save time required to schedule and mobilize a logging crew and unit when logging of a wellbore under (or directly before or after) production is desired. As another example, the downhole tool may enable independent control and operation of a logging unit separate from a pumping unit within a single tool or tool assembly. As a further example, the downhole tool may be integrated seamlessly into existing downhole pump (for example, ESP) completions.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
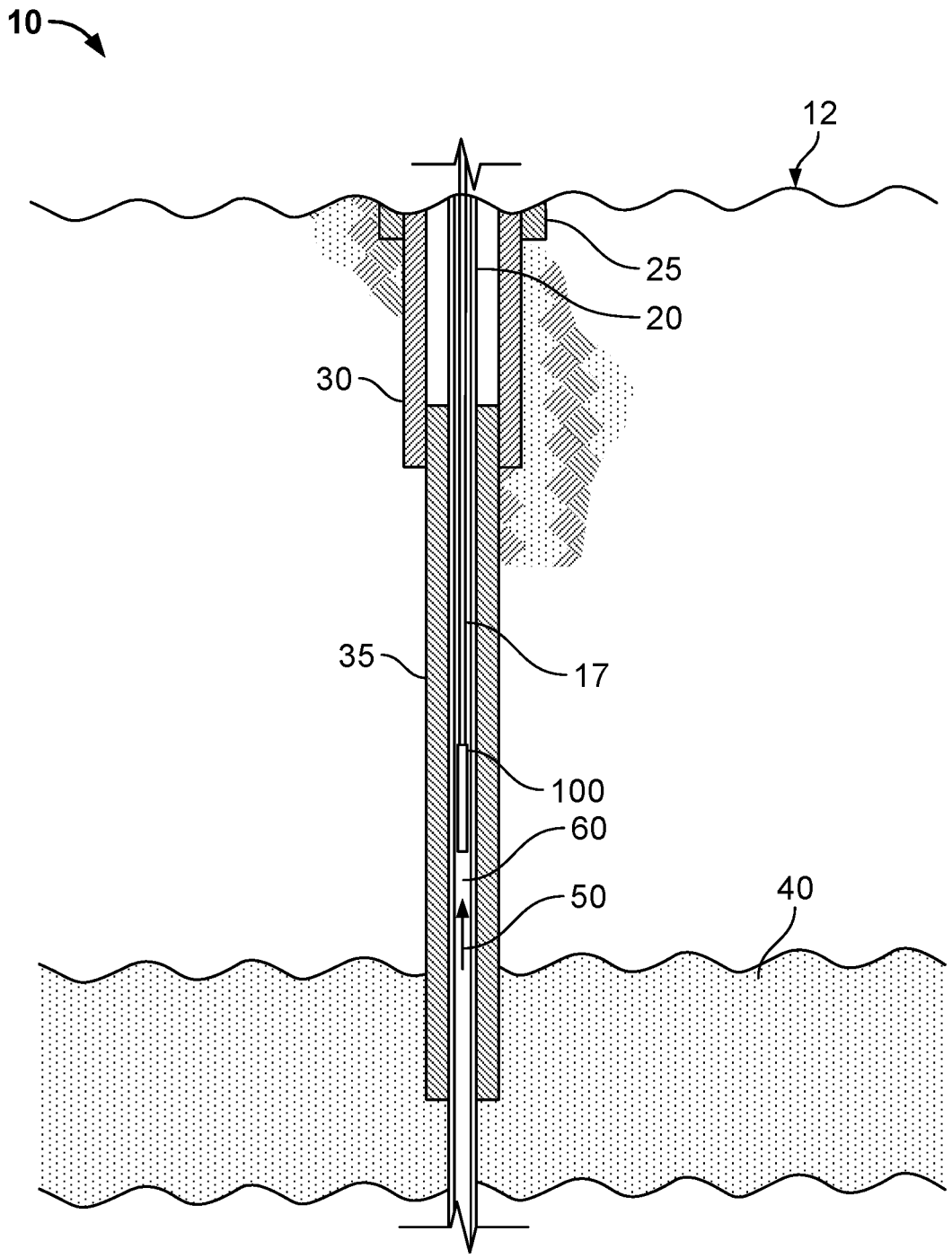
FIG. 1 is a schematic diagram of an example system that includes a downhole tool according to the present disclosure.

FIG. 1 is a schematic diagram of an example wellbore system 10 including a downhole tool 100. Generally, FIG. 1 illustrates a portion of one embodiment of a wellbore system 10 according to the present disclosure in which the downhole tool 100 may be run into a wellbore 20 and operated when the downhole tool 100 reaches a particular location of a wellbore tubular 17 (or simply, tubular 17 or production string 17) within the wellbore 20. The downhole tool 100, in some aspects, includes a production unit (or sub-assembly) that is integrated with or coupled to a logging unit (or sub-assembly) without a Y tool or other bypass tool. In some aspects, the production unit operates to produce the production fluid 50 toward a terranean surface 12 within the wellbore tubular 17 while the logging unit logs a portion of the wellbore 20 downhole of the downhole tool 100. In some aspects, the production unit ceases production operation while the logging unit logs the portion of the wellbore 20 downhole of the downhole tool 100. In some aspects, the production unit operates to produce the production fluid 50 toward the terranean surface 12 within the wellbore tubular 17 without simultaneous operation of the logging unit.

As shown, the wellbore system 10 accesses a subterranean formation 40 and provides access to the production fluid 50 (for example, hydrocarbons or otherwise) located in such subterranean formation 40. In an example implementation of system 10, the system 10 may be used for a production operation in which a production fluid 50 (for example, oil, gas, mixed oil and gas, water) may be produced from the subterranean formation 40 within the wellbore tubular 17 (for example, as a production tubing).

A drilling assembly (not shown) may be used to form the wellbore 20 extending from the terranean surface 12 and through one or more geological formations in the Earth. One or more subterranean formations, such as subterranean zone 40, are located under the terranean surface 12. As will be explained in more detail below, one or more wellbore casings, such as a surface casing 30 and intermediate casing 35, may be installed in at least a portion of the wellbore 20. In some embodiments, a drilling assembly used to form the wellbore 20 may be deployed on a body of water rather than the terranean surface 12. For instance, in some embodiments, the terranean surface 12 may be submerged under an ocean, gulf, sea, or any other body of water under which hydrocarbon-bearing formations may be found. In short, reference to the terranean surface 12 includes both land and underwater surfaces and contemplates forming and developing one or more wellbore systems 10 from either or both locations.

In some embodiments of the wellbore system 10, the wellbore 20 may be cased with one or more casings. As illustrated, the wellbore 20 includes a conductor casing 25, which extends from the terranean surface 12 shortly into the Earth. A portion of the wellbore 20 enclosed by the conductor casing 25 may be a large diameter borehole. Additionally, in some embodiments, the wellbore 20 may be offset from vertical (for example, a slant wellbore). Even further, in some embodiments, the wellbore 20 may be a stepped wellbore, such that a portion is drilled vertically downward and then curved to a substantially horizontal wellbore portion. Additional substantially vertical and horizontal wellbore portions may be added according to, for example, the type of terranean surface 12, the depth of one or more target subterranean formations, the depth of one or more productive subterranean formations, or other criteria.

Downhole of the conductor casing 25 may be the surface casing 30. The surface casing 30 may enclose a slightly smaller borehole and protect the wellbore 20 from intrusion of, for example, freshwater aquifers located near the terranean surface 12. The wellbore 20 may then extend vertically downward. This portion of the wellbore 20 may be enclosed by the intermediate casing 35. In some aspects, the intermediate casing 35 may be a production casing 35 in which one or more perforations (not shown in FIG. 1) may be formed to fluidly couple an annulus 60 of the wellbore 20 with the subterranean formation 40. In some aspects, one or more hydraulic fractures (not shown) may also be formed in the subterranean formation 40 from the wellbore 20 in order to enhance or increase production of the production fluid 50 into the wellbore 20.

As shown in FIG. 1, the downhole tool 100 may be run into the wellbore 20 from the terranean surface 12 and positioned adjacent the subterranean formation 40. Once positioned, the downhole tool 100 may be operated to perform production and logging operations as described in more detail with reference to the remaining figures. In some aspects, the production and logging operations may be performed serially or in parallel with the downhole tool 100.

Figure 2A:
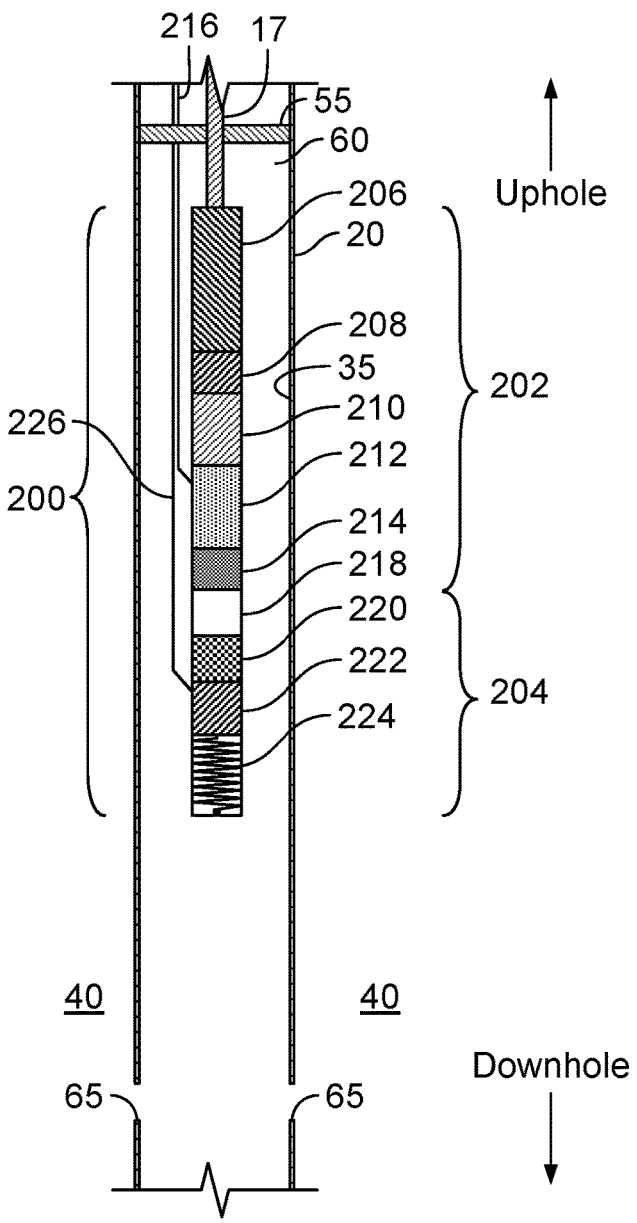
FIGS. 2A and 2B are schematic diagrams of an example implementation of a downhole tool according to the present disclosure during non-production of a wellbore fluid.
Figure 2B:
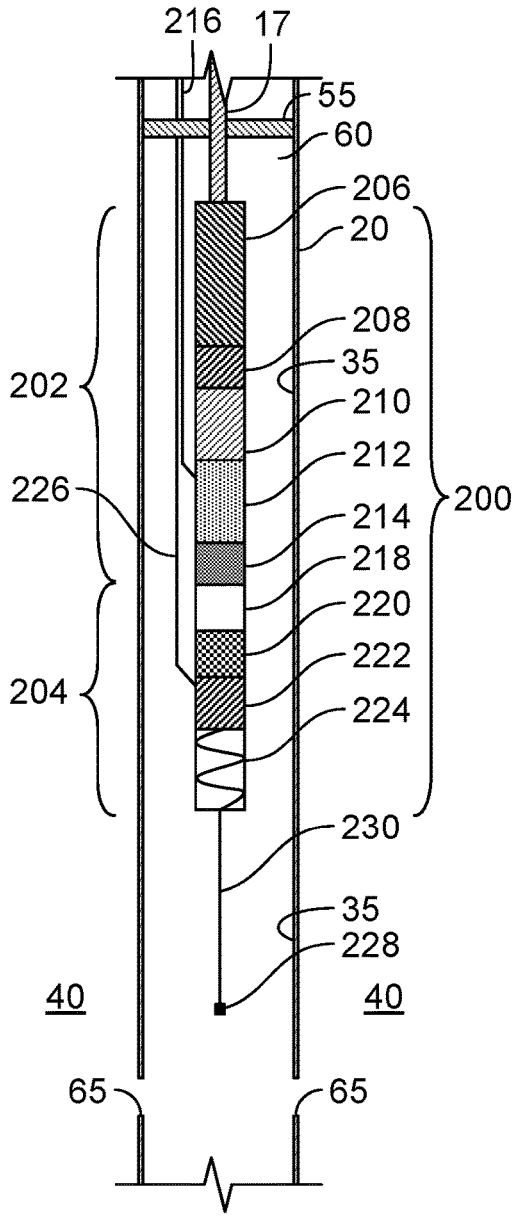

FIGS. 2A-2B are schematic diagrams of an example implementation of a downhole tool 200 during non-production of a wellbore fluid, such as, the production fluid 50 shown in FIG. 1. In some aspects, downhole tool 200 may be used as the downhole tool 100 in the wellbore system 10 of FIG. 1. FIG. 2A illustrates the downhole tool 200 and its components when positioned in the wellbore 20 as shown. FIG. 2A illustrates the downhole tool 200 during a logging operation (for example, logging of a portion of the wellbore 20 downhole of the tool 200) but not during a simultaneous production operation (for example, producing a wellbore fluid to the production tubing 17 with the downhole tool 200). As shown in FIG. 2A, the downhole tool 200 includes a production unit 202 and a logging unit 204 that is coupled to a downhole end of the production unit 202. In this example, the logging unit 204 is coupled directly to the downhole end of the production unit 202. The production unit 202 is coupled (for example, fluidly and mechanically) to the production tubing 17. The downhole tool 200 is positioned within the production casing 35 and adjacent the subterranean formation 40 within the wellbore 20.

In this example, the downhole tool 200 is positioned just uphole of perforations 65 that have been formed (for instance, shot) in the production casing 35. As shown in this example, downhole tool 200 is positioned downhole of a wellbore seal 55 (for example, a packer, bridge plug, or other wellbore seal) within the annulus 60 of the wellbore 20. The production tubing 17 extends through the wellbore seal 55 and to the surface. The wellbore seal 55, therefore, creates a production zone of the wellbore 20 downhole of the seal 55, and wellbore fluids (such as production fluid 50) are not fluidly communicated from the production zone uphole of the wellbore seal 55.

In this example implementation of the downhole tool 200, the production unit 202 includes a pump 206. In some aspects, the pump 206 is an electrical submersible pump (ESP) (ESP 206). Alternatively, the pump 206 may be a progressive cavity pump, centrifugal pump, or other downhole artificial lift device that obstructs access to the subterranean formation 40 for logging purposes. The pump 206, in this example, is used to lift wellbore fluids (for example, production fluid 50) to the terranean surface 12, or if at or near the terranean surface 12, transfers fluid from one location to another.

Directly downhole of the pump 206 in the production unit 202 is an intake 208. The intake 208 includes one or more apertures (for example, adjustable to open and close or fixed in an open position) that fluidly couples the pump 206 with the annulus 60 of the wellbore 20. The pump 206, in fluid communication with the annulus 60 through the intake 208, may then receive a wellbore fluid therein to lift the fluid to the terranean surface 12 during operation.

In some aspects, the pump 206 includes one or more stages, each of which comprises an impeller and a diffuser. An impeller, which is rotating, adds energy to the wellbore fluid received into the intake 208 to provide head. The diffuser, which is stationary, converts the kinetic energy of the wellbore fluid from the impeller into head. In some aspects, the pump stages are stacked in series to form a multi-stage system that is contained within the pump 206. The sum of head generated by each individual stage is cumulative; hence, the total head developed by a multi-stage system increases linearly from the first to the last stage of the pump 206.

In this example, a pump motor protector 210 is coupled to the intake 208 and to a pump motor 212. The pump motor 212, generally, provides mechanical power required to drive the pump 206 via a shaft. As shown in this example, the pump motor 212 is an electric motor that receives electric power through a pump power cable 216 that extends through the annulus 60 (and through the wellbore seal 55) to electrically couple to the pump motor 212. Thus, in this example, the pump power cable 216 provides electrical power from the terranean surface 12 to the pump motor 212. The pump motor protector 210, in this example, operates to absorb a thrust load from the pump 206, transmits power from the motor 212 to the pump 206, equalizes pressure, provides/receives additional motor oil as the motor temperature changes, and prevents wellbore fluid from entering the pump motor 212.

Certain pump motor operational parameters, such as pump intake and discharge pressures, motor oil and winding temperature, and vibration may be measured by the monitoring sub-assembly 214 that is directly coupled to a downhole end of the pump motor 212 in this example implementation. The monitoring sub-assembly 214, in this example, may communicate such measured parameters to the terranean surface 12 through the pump power cable 216.

In alternative implementations of the downhole tool 200, the pump motor 212 may be positioned uphole of the pump 206 in the tool 200. For example, the production unit 202 may include an inverted ESP, such that the pump motor 212 is uphole of the pump motor protector 210, which is uphole of the pump 206. In other alternative implementations, the downhole tool 200 may be deployed on a wireline or other cable downhole conveyance (in a regular or inverted order) rather than the production tubing 17.

As shown in FIG. 2A, the logging unit 204 is coupled to a downhole end of the production unit 202 (in other words, the monitoring sub-assembly 214), through a spacer 218. In some aspects, the spacer 218 is part of the logging unit 204. The spacer 218, in this example, is attached above a spooler motor protector 220, and provides an axial distance between the spooler motor protector 220 and the monitoring sub-assembly 214 of the production unit 202. In some aspects, there is no shaft through the spacer 218, thus ensuring no contact between a rotating shaft of the spooler motor protector 220 and the (non-rotating) monitoring sub-assembly 214.

Directly coupled to the spooler motor protector 220 is a spooler motor 222. The spooler motor 222, in this example, is an electric motor that includes a motor shaft coupled to a shaft of a cable spooler 224 coupled to the downhole end of the spooler motor 222. The spooler motor 222, in this example, provides the mechanical power to rotate the shaft of the cable spooler 224 to unwind a logging cable 230. In some aspects, the electrical power to drive the spooler motor 222 is provided from the terranean surface 12 via by a spooler power cable 226 dedicated for the spooler motor 222. Alternatively, the spooler power cable 226 can be eliminated and electric power to the spooler motor 222 can be provided via an addressable power unit via the pump power cable 216.

In the illustrated implementation, there may be little or no pump thrust load to be handled by the spooler motor protector 220. Thus, in some aspects, no thrust bearing or a very low-capacity thrust bearing may be used in the spooler motor protector 220 to take up any residual thrust loads. In some aspects, the spooler motor protector 220 may operate primarily to equalize pressure, provide/receive additional oil to/from the spooler motor 222 as temperature changes, and prevent wellbore fluid from entering the spooler motor 222.

Coupled to the spooler motor 222 is a cable spooler 224 on which a length of the logging cable 230 (shown in FIG. 2B) is spooled for storage and spoolable off of the cable spooler 224 to log the wellbore 20. In the example implementation, the spooler motor 222 is attached above the cable spooler 224 and the motor shaft is coupled to a shaft within the cable spooler 224. As the shaft of the spooler motor 222 rotates, the shaft of the cable spooler 224 rotates to unspool the logging cable 230 off of the cable spooler 224, or spool the logging cable 230 onto the cable spooler 224. For storage purposes (such as during a production only operation or during running into or out of the wellbore), the logging cable 230 can be wrapped round a shaft or drum (not shown) within the cable spooler 224.

As shown in FIG. 2B, a weight 228 is attached to an end of the logging cable 230 (and another end of the logging cable 230 may be attached to the cable spooler 224). In some aspects, the weight 228 may be selected to ensure that the logging cable is not damaged during cable unspooling, but yet able to be lowered into the wellbore 20 even during production operations of the production unit 202 (as explained later). In some aspects, the weight 228 may also be selected to ensure that the logging cable 230 can be lowered in a downhole direction from the cable spooler 224 due to gravity, and also to keep the logging cable 230 taut after unspooling (for example, during a logging operation).

In this example, the logging cable 230 may be a fiber optic logging cable. For example, the fiber optic logging cable can be a single mode or multimode cable, but in the preferred implementation, a multimode fiber optic cable may be used. In some aspects, logging data may be communicated to the terranean surface 12 via either a dedicated fiber embedded in the spooler motor power cable 226. Alternatively, a laser source for the fiber optic cable and electronics may be included to convert a light pulse to an electronic signal and incorporated in a housing just above the cable spooler 224.

In some alternative aspects, logging data may be transmitted electrically via communication over power on the spooler motor power cable 226. For example, if the fiber optic cable is carried via an embedded fiber optic in the spooler motor power cable 226 to the terranean surface 12, the laser light source could be located at the terranean surface 12. Further, electronic signal processing for the received logging data may occur at the terranean surface 12. In some aspects, a fiber optic rotary union (for example, by Moog Inc. (www.moog.com/products/fiber-optic-rotary-joints.html)) may be used at the cable spooler 224 to allow the transmission of the light from a stationary fiber optic cable as part of the spooler motor power cable 226 to the logging cable 230 that moves and rotates on the cable spooler 224.

As shown in FIG. 2A, the downhole tool 200 is positioned in the wellbore 20 (for example, adjacent or near perforations 65 made in the production casing 35) but is not shown performing a production or logging operation. In some aspects, the downhole tool 200 may simultaneously perform production and logging operations (without running the downhole tool 200 out of the wellbore or running a separate logging tool into the wellbore). In some aspects, the downhole tool 200 may perform a production operation without performing a logging operation. In some aspects, the downhole tool 200 may perform a logging operation without performing a production operation. For example, FIG. 2B shows an example in which the downhole tool 200 is performing a logging operation of a portion of the wellbore 20 (in other words, the subterranean formation 40) downhole of the downhole tool 200 without performing a production operation (such as prior or subsequent to a previous production operation without running the downhole tool 200 out of the wellbore or running a separate logging tool into the wellbore).

In an example operation illustrated in FIG. 2B, the spooler motor 222 operates to rotate the shaft of the cable spooler 224 to unspool the logging cable 230 as shown in FIG. 2B. In some aspects, a maximum depth that can be reached within the wellbore 20 by the logging cable 230 is a function of the cable length available within the cable spooler 224. As the logging cable 230 unspools, the weight 228 may help "pull" the logging cable 230 in a direction downhole while also keeping the logging cable 230 taut and stable within the wellbore 20. Once the desired logging depth is reached by at least a portion of the logging cable 230, motor rotation of the cable spooler motor 222 can be stopped. Logging of reservoir pressure and temperature is performed via the logging cable 230. The data received from the logging cable 230 is transmitted, for example, through the spooler motor power cable 226 to the terranean surface 12. The logging data generated from such a log can be used to obtain characteristics of the subterranean formation 40, such as pressure, temperature, and other data. Once logging has been completed, the spooler motor 222 can be switched on to rotate in a direction opposite that during the logging cable unspooling operation. This ensures that the logging cable 230 retracts back onto the cable spooler 224 to the original position as shown in FIG. 2A. Operation of the spooler motor 222 can be commanded, for example, according to commands provided from the terranean surface 12 (for example, through the power cable 226), from preprogrammed instructions in the logging unit 204, or otherwise.

Figure 3A:
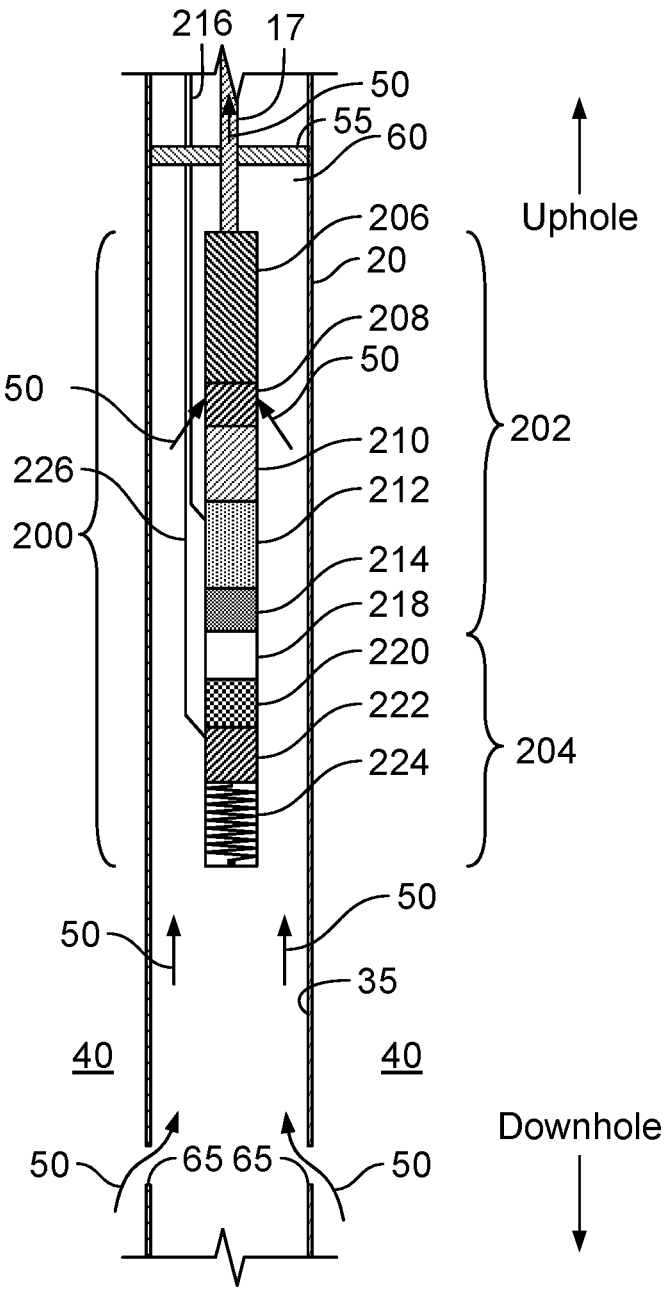
FIGS. 3A and 3B are schematic diagrams of the downhole tool of FIGS. 2A and 2B during production of a wellbore fluid.

FIG. 3A illustrates a situation in which the downhole tool 200 is performing a production operation without performing a logging operation. In this example, a production operation includes operation of the production unit 202 so that the pump 206 is operated (in other words, rotated) by the pump motor 212 to circulate production fluid 50 from the wellbore 20 to the terranean surface 12. Electric power may be supplied to the pump motor 212 through the pump power cable 216, which initiates operation of the pump motor 212. The operating pump motor 212, in turn, rotates the pump 206 to circulate production fluid 50 from the subterranean formation 40, through the perforations 65, and into the intake 208 of the production unit 202. The pump 206 continues to operate to lift the production fluid 50 through the intake 208 and into the production tubing 17 to the terranean surface 12.

Figure 3B:
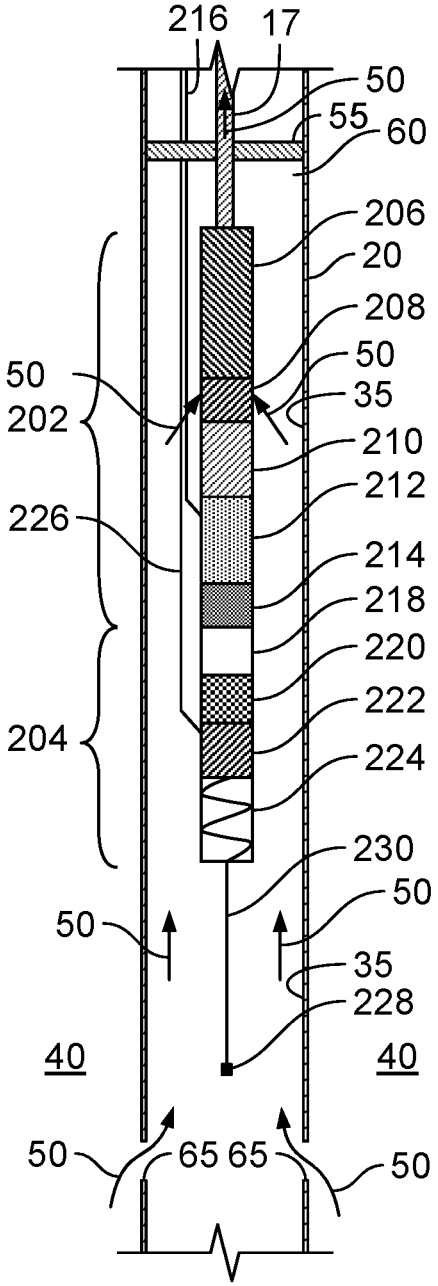

FIG. 3B illustrates a situation in which the downhole tool 200 is performing a production operation simultaneously while performing a logging operation. For example, as described with reference to FIG. 3A, the production unit 202 may be operated to circulate production fluid 50 from the subterranean formation 40, through the perforations 65, into the intake 208 and through the intake 208 and into the production tubing 17 to the terranean surface 12. Simultaneously with operation of the production unit 202, the logging unit 204 may be operated (for example, as described with reference to FIG. 2B) to log the subterranean formation 40 downhole of the downhole tool 200. For example, the logging unit 204 can be operated to unspool the logging cable 230 from the cable spooler 224 to a particular downhole depth below the downhole tool 200. The logging cable 230 can then measure particular formation parameters, such as temperature, pressure, resistivity, gamma ray, sonic. The measured data can be transmitted, for example, to the terranean surface 12 on the spooler motor power cable 226 (or within, for instance, a fiber optic cable embedded in the power cable 226).

In some aspects, downhole tool 200, which includes the pump 206 within the production unit 202, may be used for subterranean formations that do not have sufficient natural drive (for example, pressure difference between formation pressure and the wellbore 20) to lift wellbore fluid into the production unit 202 (and through the production tubing 17) to the terranean surface 12. Alternatively, in some aspects, the downhole tool 200 may be used in reservoirs with some natural drive, but the pump 206 of the production unit 202 is used to boost production (for instance, flow rate) of the production fluid 50 to the terranean surface 12.

Figure 4A:
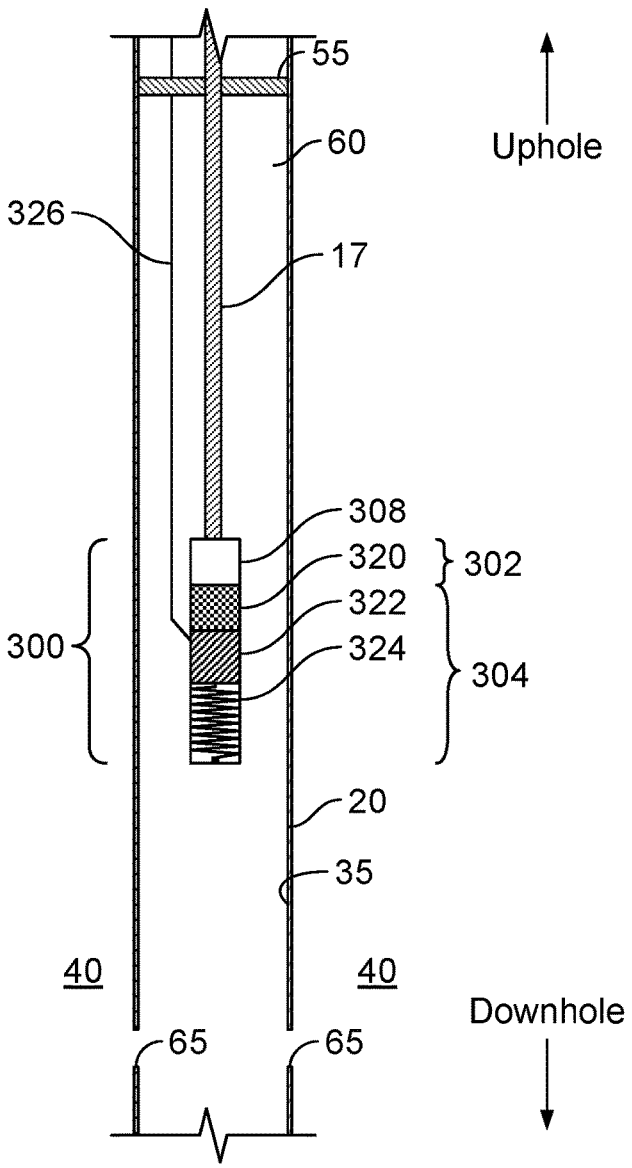
FIGS. 4A and 4B are schematic diagrams of another example implementation of a downhole tool according to the present disclosure during non-production of a wellbore fluid.
Figure 4B:
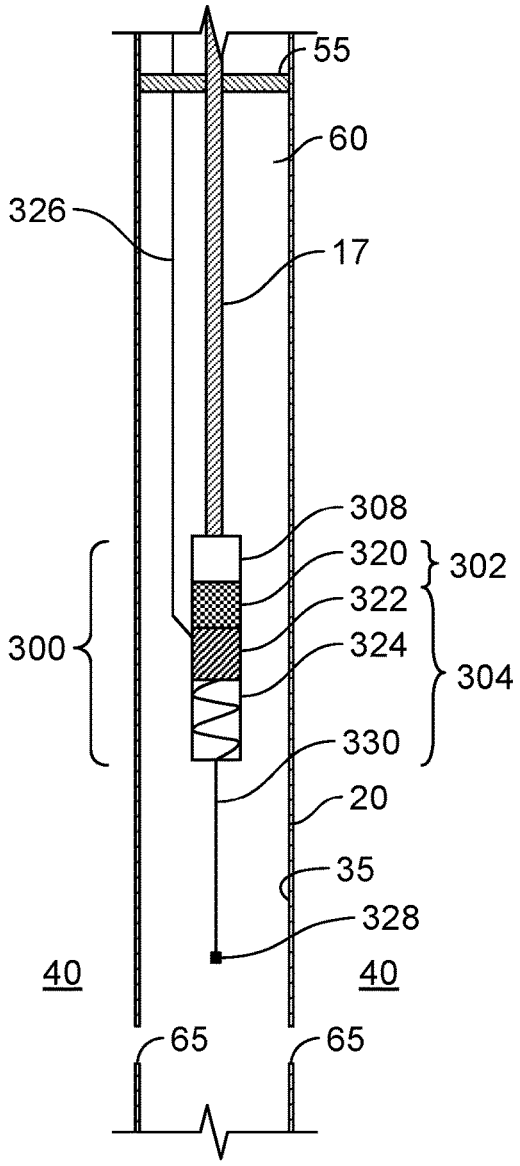

FIGS. 4A-4B are schematic diagrams of another example implementation of a downhole tool 300 during non-production of a wellbore fluid, such as, the production fluid 50 shown in FIG. 1. In some aspects, downhole tool 300 may be used as the downhole tool 100 in the wellbore system 10 of FIG. 1. FIG. 4A illustrates the downhole tool 300 and its components when positioned in the wellbore 20 as shown. FIG. 4B illustrates the downhole tool 300 during a logging operation (for example, logging of a portion of the wellbore 20 downhole of the tool 300) but not during a simultaneous production operation (for example, producing a wellbore fluid to the production tubing 17 with the downhole tool 300). As shown in FIG. 4A, the downhole tool 300 includes a production unit 302 and a logging unit 304 that is coupled to a downhole end of the production unit 302. In this example, the logging unit 304 is coupled directly to the downhole end of the production unit 302. The production unit 302 is coupled (for example, fluidly and mechanically) to the production tubing 17. The downhole tool 300 is positioned within the production casing 35 and adjacent the subterranean formation 40 within the wellbore 20.

In this example, the downhole tool 300 is positioned just uphole of perforations 65 that have been formed (for instance, shot) in the production casing 35. As shown in this example, downhole tool 300 is positioned downhole of a wellbore seal 55 (for example, a packer, bridge plug, or other wellbore seal) within the annulus 60 of the wellbore 20. The production tubing 17 extends through the wellbore seal 55 and to the surface. The wellbore seal 55, therefore, creates a production zone of the wellbore 20 downhole of the seal 55, and wellbore fluids (such as production fluid 50) are not fluidly communicated from the production zone uphole of the wellbore seal 55.

In this example implementation of the downhole tool 300, the production unit 302 includes an intake 308, but not a pump (or other artificial lift device). The intake 308 includes one or more apertures (for example, adjustable to open and close or fixed in an open position) that fluidly couples the production unit 302 (and thus the production tubing 17) with the annulus 60 of the wellbore 20. The intake 308 may receive a wellbore fluid therein to communicate the fluid to the terranean surface 12 during operation. For example, in some aspects, the downhole tool 300 with production unit 302 may be used in reservoirs with sufficient natural energy (for instance, difference in formation pressure vs. annulus pressure) to drive the wellbore fluid into the intake 308 and up the production tubing 17 to the terranean surface 12.

As shown in FIG. 4A, the logging unit 304 is coupled to a downhole end of the production unit 302 (in other words, the intake 308). In this example, a spooler motor protector 320 is directly coupled to the intake 308 of the production unit 302. Directly coupled to the spooler motor protector 320 is a spooler motor 322. The spooler motor 322, in this example, is an electric motor that includes a motor shaft coupled to a shaft of a cable spooler 324 coupled to the downhole end of the spooler motor 322. The spooler motor 322, in this example, provides the mechanical power to rotate the shaft of the cable spooler 324 to unwind a logging cable 330. In some aspects, the electrical power to drive the spooler motor 322 is provided from the terranean surface 12 via by a spooler power cable 326 dedicated for the spooler motor 322.

In the illustrated implementation, there may be little or no pump thrust load to be handled by the spooler motor protector 320. Thus, in some aspects, no thrust bearing or a very low-capacity thrust bearing may be used in the spooler motor protector 320 to take up any residual thrust loads. In some aspects, the spooler motor protector 320 may operate primarily to equalize pressure, provide/receive additional oil to/from the spooler motor 322 as temperature changes, and prevent wellbore fluid from entering the spooler motor 322.

Coupled to the spooler motor 322 is a cable spooler 324 on which a length of the logging cable 330 (shown in FIG. 4B) is spooled for storage and spoolable off of the cable spooler 324 to log the wellbore 20. In the example implementation, the spooler motor 322 is attached above the cable spooler 324 and the motor shaft is coupled to a shaft within the cable spooler 324. As the shaft of the spooler motor 322 rotates, the shaft of the cable spooler 324 rotates to unspool the logging cable 330 off of the cable spooler 324, or spool the logging cable 330 onto the cable spooler 324. For storage purposes (such as during a production only operation or during running into or out of the wellbore), the logging cable 330 can be wrapped round a shaft or drum (not shown) within the cable spooler 324.

As shown in FIG. 4B, a weight 328 is attached to an end of the logging cable 330 (and another end of the logging cable 330 may be attached to the cable spooler 324). In some aspects, the weight 328 may be selected to ensure that the logging cable is not damaged during cable unspooling, but yet able to be lowered into the wellbore 20 even during production operations of the production unit 302 (as explained later). In some aspects, the weight 328 may also be selected to ensure that the logging cable 330 can be lowered in a downhole direction from the cable spooler 324 due to gravity, and also to keep the logging cable 330 taut after unspooling (for example, during a logging operation).

In this example, the logging cable 330 may be a fiber optic logging cable. For example, the fiber optic logging cable can be a single mode or multimode cable, but in the preferred implementation, a multimode fiber optic cable may be used. In some aspects, logging data may be communicated to the terranean surface 12 via either a dedicated fiber embedded in the spooler motor power cable 326. Alternatively, a laser source for the fiber optic cable and electronics may be included to convert a light pulse to an electronic signal and incorporated in a housing just above the cable spooler 324.

In some alternative aspects, logging data may be transmitted electrically via communication over power on the spooler motor power cable 326. For example, if the fiber optic cable is carried via an embedded fiber optic in the spooler motor power cable 326 to the terranean surface 12, the laser light source could be located at the terranean surface 12. Further, electronic signal processing for the received logging data may occur at the terranean surface 12. In some aspects, a fiber optic rotary union (for example, by Moog Inc. (www.moog.com/products/fiber-optic-rotary-joints.html)) may be used at the cable spooler 324 to allow the transmission of the light from a stationary fiber optic cable as part of the spooler motor power cable 326 to the logging cable 330 that moves and rotates on the cable spooler 324.

As shown in FIG. 4A, the downhole tool 300 is positioned in the wellbore 20 (for example, adjacent or near perforations 65 made in the production casing 35) but is not shown performing a production or logging operation. In some aspects, the downhole tool 300 may simultaneously perform production and logging operations (without running the downhole tool 300 out of the wellbore or running a separate logging tool into the wellbore). In some aspects, the downhole tool 300 may perform a production operation without performing a logging operation. In some aspects, the downhole tool 300 may perform a logging operation without performing a production operation. For example, FIG. 4B shows an example in which the downhole tool 300 is performing a logging operation of a portion of the wellbore 20 (in other words, the subterranean formation 40) downhole of the downhole tool 300 without performing a production operation (such as prior or subsequent to a previous production operation without running the downhole tool 300 out of the wellbore or running a separate logging tool into the wellbore).

In an example operation illustrated in FIG. 4B, the spooler motor 322 operates to rotate the shaft of the cable spooler 324 to unspool the logging cable 330 as shown in FIG. 4B. In some aspects, a maximum depth that can be reached within the wellbore 20 by the logging cable 330 is a function of the cable length available within the cable spooler 324. As the logging cable 330 unspools, the weight 328 may help "pull" the logging cable 330 in a direction downhole while also keeping the logging cable 330 taut and stable within the wellbore 20. Once the desired logging depth is reached by at least a portion of the logging cable 330, motor rotation of the cable spooler motor 322 can be stopped. Logging of reservoir pressure and temperature is performed via the logging cable 330. The data received from the logging cable 330 is transmitted, for example, through the spooler motor power cable 326 to the terranean surface 12. The logging data generated from such a log can be used to obtain characteristics of the subterranean formation 40, such as pressure, temperature, and other data. Once logging has been completed, the spooler motor 322 can be switched on to rotate in a direction opposite that during the logging cable unspooling operation. This ensures that the logging cable 330 retracts back onto the cable spooler 324 to the original position as shown in FIG. 4A. Operation of the spooler motor 322 can be commanded, for example, according to commands provided from the terranean surface 12 (for example, through the power cable 326), from preprogrammed instructions in the logging unit 304, or otherwise.

Figure 5A:
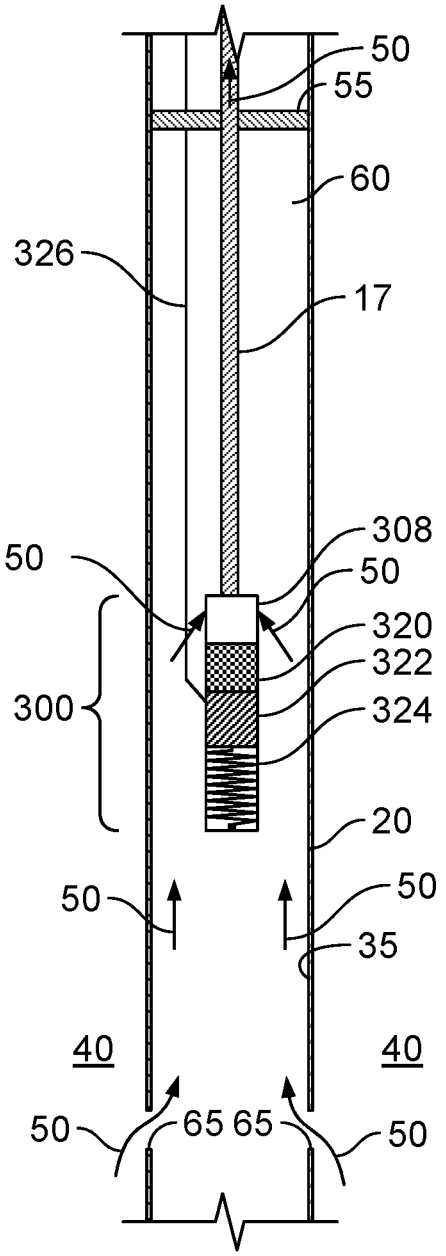
FIGS. 5A and 5B are schematic diagrams of the downhole tool of FIGS. 4A and 4B during production of a wellbore fluid.

FIG. 5A illustrates a situation in which the downhole tool 300 is performing a production operation without performing a logging operation. In this example, a production operation includes operation of the production unit 302. In some aspects, operation of the production unit 302 may include opening one or more sliding doors (or sleeves) of the intake 308 to fluidly couple the intake 308 (and production tubing 17) with the annulus 60 of the wellbore 20. Alternatively, a plug or seal internal to the intake 308 may be removed or adjusted to fluidly couple the intake 308 (and production tubing 17) with the annulus 60 of the wellbore 20. Once fluidly coupled, the production fluid 50 circulates into the intake 308 (for instance, due to the natural drive of the subterranean formation 40) and up the production tubing 17 to the terranean surface 12.

Figure 5B:
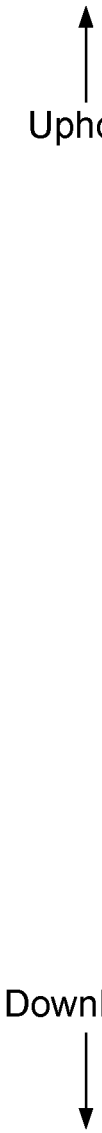
Figure 5B:
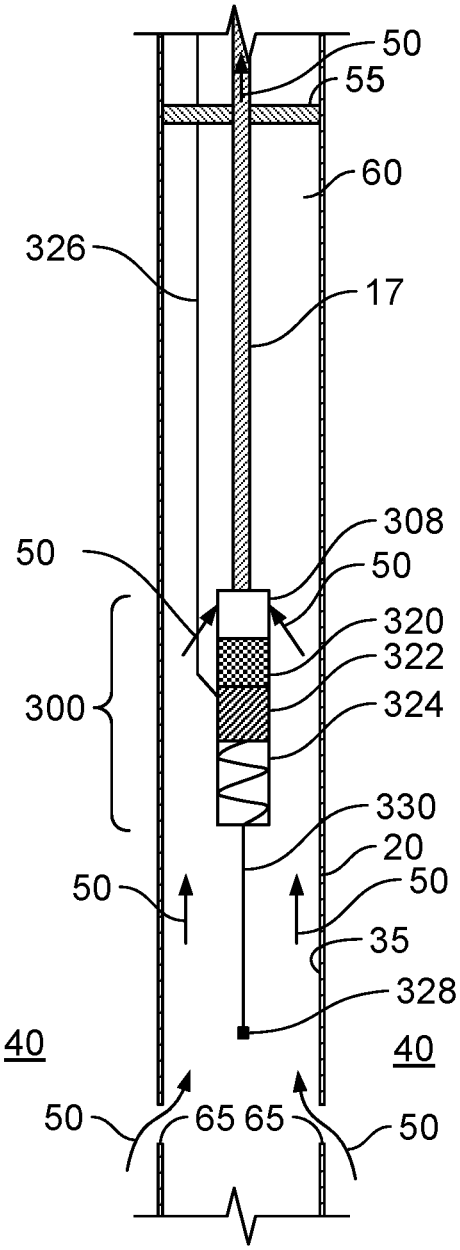

FIG. 5B illustrates a situation in which the downhole tool 300 is performing a production operation simultaneously while performing a logging operation. For example, as described with reference to FIG. 5A, the production unit 302 may be operated to circulate production fluid 50 from the subterranean formation 40, through the perforations 65, into the intake 308 and through the intake 308 and into the production tubing 17 to the terranean surface 12. Simultaneously with operation of the production unit 302, the logging unit 304 may be operated (for example, as described with reference to FIG. 4B) to log the subterranean formation 40 downhole of the downhole tool 300. For example, the logging unit 304 can be operated to unspool the logging cable 330 from the cable spooler 324 to a particular downhole depth below the downhole tool 300. The logging cable 330 can then measure particular formation parameters, such as temperature, pressure, resistivity, gamma ray, sonic. The measured data can be transmitted, for example, to the terranean surface 12 on the spooler motor power cable 326 (or within, for instance, a fiber optic cable embedded in the power cable 326).

Figure 6:
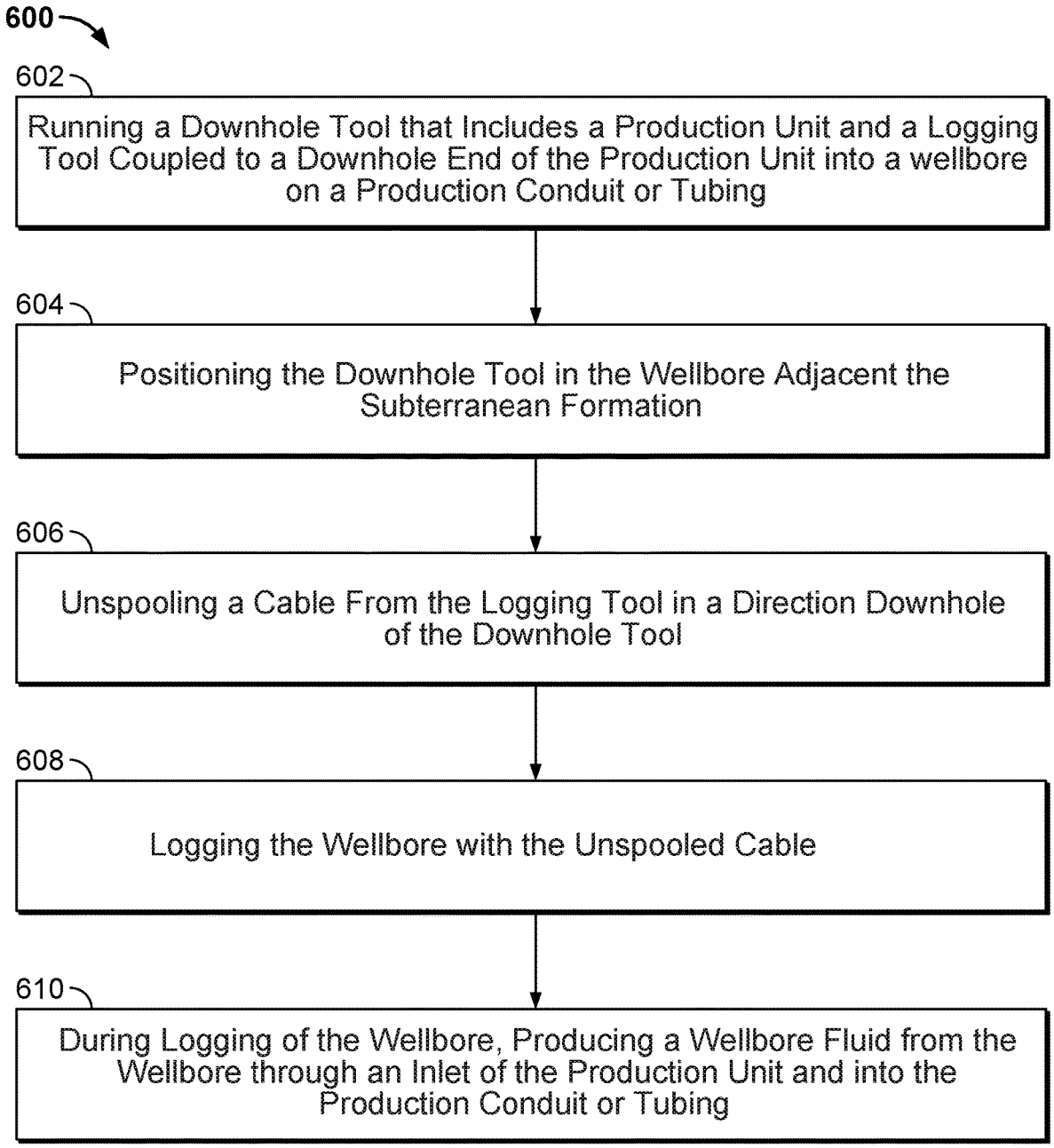
FIG. 6 is a flowchart that describes an example operation with a downhole tool according to the present disclosure.

FIG. 6 illustrates a flowchart of a method 600 for an example operation with a downhole tool, such as the downhole tool 200 or the downhole tool 300. Method 600 may begin at step 602, which includes running a downhole tool that includes a production unit and a logging tool coupled to a downhole end of the production unit into a wellbore on a production string. For example, the downhole tool 200 or the downhole tool 300 may be run into the wellbore 20 on a downhole conveyance, such as the production conduit or tubing 17. In alternative aspects, the tool 200 or the tool 300 may be run into the wellbore 20 on a different type of downhole conveyance, such as a wireline or other cable conveyance. In some aspects, the wellbore 20 includes the production casing 35 (and other casings) through which the downhole tool 200 or the downhole tool 300 may be inserted.

Method 600 may continue at step 604, which includes positioning the downhole tool in the wellbore adjacent a subterranean formation. For example, once in the wellbore 20, the downhole tool 200 or the downhole tool 300 may be positioned at or near a subterranean formation, such as formation 40, from which a wellbore fluid is produced. In some aspects, the wellbore fluid is a hydrocarbon fluid, such as oil, gas, or a mixed phases of oil and gas. Alternatively, the subterranean formation may produce another fluid, such as brine. In some aspects, as part of step 604 (or just subsequent to step 604), a wellbore seal, such as packer 55, may be set in the wellbore uphole of the positioned downhole tool in order to define a production zone downhole of the wellbore seal. Wellbore fluid downhole of the wellbore seal, therefore, may not pass through the annulus 60 of the wellbore 20 across the seal.

Method 600 may continue at step 606, which includes unspooling a cable from the logging tool in a direction downhole of the downhole tool. For example, once the downhole tool 200 or downhole tool 300 is at the desired position, a logging operation may commence with a logging unit (unit 204 or 304, respectively) of the downhole tool 200 or 300. As described, the logging cable may be unspooled from a cable spooler (224 or 324) through operation of a spooler motor (222 or 322) that is rotatably coupled to the cable spooler. In some aspects, power to the spooler motor may be received from a spooler motor power cable (226 or 326) that extends to the logging unit from the terranean surface 12. Alternatively, power to the spooler motor may be received from a pump power cable 216 that extends to the production unit from the terranean surface 12. In still other aspects, power to the spooler motor may be received from a power source internal to the downhole tool, such as a battery or other stored electrical energy source.

In some aspects, unspooling the logging cable also includes maintaining the logging cable relatively concentric with a radial centerline axis of the wellbore 20. For example, a weight (228 or 328) may be placed on an end of the logging cable and exert a force in a downhole direction (due to gravity) to keep the logging cable relatively centered in the wellbore 20, as well as taut.

Method 600 may continue at step 608, which includes logging at least a portion of the wellbore with the unspooled cable. For example, the logging cable, in some aspects, may include or be a fiber optic logging cable that includes one or more sensors. Such sensors include, for example, pressure, temperature, resistivity, gamma, or sonic to name a few. Logging data from the subterranean formation 40, the wellbore fluid, or both, may be measured by the one or more sensors. In some aspects, step 608 also includes transmitting such measured data to the terranean surface 12. For example, the measured logging data may be transmitted to the terranean surface 12 on a dedicated fiber optic cable that extends from the logging unit to the surface 12, or within the spooler motor power cable (or other power cable) that extends from the downhole tool 200 or 300 to the terranean surface 12. Alternatively, such measured data may be stored (for example, in a non-transitory computer media) within the downhole tool 200 or 300 and later retrieved once the tool 200 or 300 is run out of the wellbore 20 and brought to the surface 12.

Method 600 may continue at step 610, which includes, during logging of the wellbore, producing a wellbore fluid from the wellbore through an inlet of the production unit and into the production conduit or tubing. For example, in the case of the downhole tool 200, the production unit 202 includes a pump assembly (such as an ESP assembly) that includes pump 206 and pump motor 212 (as well as other components as described). The pump motor 212 may operate the pump 206 to circulate the wellbore fluid (for example, production fluid 50) through an intake 208 of the production unit 202 and into the production conduit or tubing 17. Such a scenario may occur, for example, when the subterranean formation 40 does not have sufficient natural drive to produce the wellbore fluid to the terranean surface 12 without artificial lift. In the case of the downhole tool 300, the production unit 302 includes an intake 308, through which wellbore fluid may naturally circulate and enter the production conduit or tubing 17 to be produced to the terranean surface 12. Such a scenario may occur, for example, when the subterranean formation 40 has sufficient natural drive to produce the wellbore fluid to the terranean surface 12 without artificial lift.

In some aspects, the steps of method 600 may be performed in a different order without departing from the scope of the present disclosure. For example, step 610 may be performed between steps 604 and 606. Thus, in some aspects, the production step 610 may begin prior to the logging steps 606-608, and continue during the logging steps 606-608. Alternatively, in some aspects, the logging steps 606-608 may be performed absent the production step 610. In other aspects, the production step 610 may be performed absent the logging steps 606-608. In some aspects, steps 606-608 may be performed prior to step 610, may not be performed during the performance of step 610, but may be performed again subsequent to the production step 610.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool, comprising:

a production unit configured to fluidly couple to a production tubing positioned in a wellbore that is formed from a terranean surface to a subterranean formation, the production unit comprising an inlet configured to fluidly couple to the wellbore to receive a production fluid, and the downhole tool configured such that the production unit is unattached to the wellbore along a length of the production unit; and a logging unit coupled to a downhole end of the production unit, the logging unit comprising:

a cable that comprises a fiber optic cable having one or more logging sensors including at least one of a pressure sensor, a temperature sensor, a resistivity sensor, a gamma sensor, or a sonic sensor, a weight attached to a downhole end of the fiber optic cable and dedicated to pulling the fiber optic cable in a downhole direction to stabilize the fiber optic cable within the wellbore, a cable spooler configured to move the fiber optic cable from the cable spooler through the wellbore downhole of the production unit, the cable spooler defining a downhole end of the logging unit when the fiber optic cable is retracted about the cable spooler, and a cable motor configured to operate the cable spooler to move the fiber optic cable through the wellbore downhole of the production unit to log the wellbore downhole of the production unit with the one or more logging sensors during flow of the production fluid into the inlet.

2. The downhole tool of claim 1, wherein the production unit comprises a downhole pump assembly, the downhole pump assembly comprising a pump motor, a production fluid pump coupled to the pump motor, and a pump intake that comprises the inlet.

3. The downhole tool of claim 2, wherein the downhole pump assembly further comprises a monitoring sub-assembly coupled to a downhole end of the pump motor, and a motor protector coupled between the pump motor and the intake.

4. The downhole tool of claim 3, wherein the logging unit is coupled to the monitoring sub-assembly.

5. The downhole tool of claim 2, wherein the downhole pump assembly comprises an electrical submersible pump (ESP).

6. The downhole tool of claim 1, wherein the weight is configured to render the fiber optic cable taut and centered within the wellbore.

7. The downhole tool of claim 1, wherein the one or more logging sensors is configured to record at least one of a resistivity, a conductivity, a pressure, a temperature, or a sonic property of the subterranean formation.

8. The downhole tool of claim 1, wherein the logging unit is coupled to the inlet of the production unit.

9. The downhole tool of claim 8, wherein the weight is configured to render the fiber optic cable taut and centered within the wellbore.

10. The downhole tool of claim 8, wherein the one or more logging sensors is configured to record at least one of a resistivity, a conductivity, a pressure, a temperature, or a sonic property of the subterranean formation.

11. The downhole tool of claim 1, wherein the cable is communicably coupled to at least one dedicated fiber embedded in a spooler motor power cable that extends through the wellbore and is electrically coupled to the cable spooler of the logging unit to communicate logging data through the at least one dedicated fiber to the terranean surface.

12. A method, comprising:

running a downhole tool into a wellbore on a production tubular, the wellbore formed from a terranean surface to a subterranean formation, the downhole tool comprising a production unit that is unattached to the wellbore along a length of the production unit and a logging unit coupled to a downhole end of the production unit;

positioning the downhole tool in the wellbore adjacent the subterranean formation;

unspooling a fiber optic cable from a cable spooler of the logging unit in a direction downhole of the downhole tool, the cable spooler defining a downhole end of the logging unit when the fiber optic cable is retracted about the cable spooler;

pulling the fiber optic cable in the downhole direction with a weight attached to a downhole end of the fiber optic cable and dedicated to stabilizing the fiber optic cable;

with the fiber optic cable unspooled, logging the wellbore with the fiber optic cable by measuring one or more parameters of the subterranean formation with one or more sensors of the fiber optic cable, the one or more sensors being at least one of a pressure sensor, a temperature sensor, a resistivity sensor, a gamma sensor, or a sonic sensor; and during logging of the wellbore, producing a wellbore fluid from the wellbore through an inlet of the production unit and into the production tubular.

13. The method of claim 12, wherein producing the wellbore fluid from the wellbore comprises pumping the wellbore fluid from the wellbore with a downhole pump assembly of the production unit.

14. The method of claim 13, further comprising, during production of the wellbore fluid:

measuring at least one parameter associated with the downhole pump assembly; and transmitting the at least one parameter to the terranean surface.

15. The method of claim 13, wherein pumping the wellbore fluid from the wellbore with the downhole pump assembly of the production unit comprises pumping the wellbore fluid from the wellbore with an electrical submersible pump (ESP) that comprises an intake that includes the inlet.

16. The method of claim 12, wherein the one or more parameters of the subterranean formation comprises at least one of a resistivity, a conductivity, a pressure, a temperature, or a sonic property.

17. The method of claim 12, wherein producing the wellbore fluid from the wellbore comprises receiving the wellbore fluid into the inlet of the production unit based at least in part on a pressure difference between the subterranean formation and the production tubular.

18. The method of claim 17, wherein the one or more parameters of the subterranean formation comprises at least one of a resistivity, a conductivity, a pressure, a temperature, or a sonic property.

19. The method of claim 12, further comprising:

transmitting the one or more parameters of the subterranean formation from the fiber optic cable to at least one dedicated fiber embedded in a spooler motor power cable that extends through the wellbore and is electrically coupled to the cable spooler of the logging unit; and transmitting the one or more parameters of the subterranean formation through the at least one dedicated fiber to the terranean surface.

20. A downhole tool system, comprising:

an electrical submersible pump (ESP) assembly configured to couple to a downhole conveyance that comprises a production fluid flow path for a production fluid from a wellbore formed within a subterranean formation, the downhole tool system configured such that the ESP is unattached to the wellbore along a length of the ESP; and a logging sub-assembly directly coupled to a downhole end of the ESP assembly and comprising:

a logging cable comprising at least one fiber optic cable having at least one logging sensor that comprises at least one of a pressure sensor, a temperature sensor, a resistivity sensor, a gamma sensor, or a sonic sensor, a weight attached to a downhole end of the fiber optic cable and dedicated to pulling the fiber optic cable in a downhole direction to stabilize the fiber optic cable, and a cable spool configured to move the fiber optic cable from the cable spool through the wellbore downhole of the ESP, the cable spool defining a downhole end of the logging sub-assembly when the fiber optic cable is retracted about the cable spool.

21. The downhole tool system of claim 20, wherein the ESP assembly comprises:

a pump that comprises an intake configured to fluidly couple to an annulus of the wellbore to receive the production fluid from the subterranean formation; and a pump motor coupled to the intake at a downhole end of the pump.

22. The downhole tool system of claim 21, wherein the logging sub-assembly further comprises a spooler motor coupled to the cable spool and operable to spool the logging cable from and onto the cable spool.

23. The downhole tool system of claim 22, further comprising at least one power cable electrically coupled to at least one of the pump motor or the spooler motor and configured to transfer electric current to the at least one of the pump motor or the spooler motor from a terranean surface.

24. The downhole tool system of claim 22, further comprising at least one dedicated fiber embedded in a spooler motor power cable that extends through the wellbore and is electrically coupled to the spooler motor and is communicably coupled to the fiber optic cable that comprises at least one logging sensor.

25. The downhole tool system of claim 24, wherein the fiber optic cable comprises a multimode fiber optic cable.

26. The downhole tool system of claim 20, wherein the at least one logging sensor is configured to measure at least one of a resistivity, a conductivity, a pressure, a temperature, or a sonic property of the subterranean formation.

* * * * *